United States Patent [19]

Hunt et al.

[11] 4,397,230

[45] Aug. 9, 1983

[54] SCREW PRESS IMPROVEMENTS

[76] Inventors: Arthur J. Hunt; Arthur J. Hunt, Jr., both of 332 N. Halifax Dr., Ormond Beach, Fla. 32074

[21] Appl. No.: 347,439

[22] Filed: Feb. 10, 1982

[51] Int. Cl.[3] ..... B30B 9/14

[52] U.S. Cl. ..... 100/45; 100/117; 100/127; 100/96

[58] Field of Search ..... 100/45, 117, 145, 146, 100/147, 148, 149, 150, 127, 128, 129, 96

[56] References Cited

U.S. PATENT DOCUMENTS

| | | | |
|---|---|---|---|
| 1,662,531 | 3/1928 | Meakin | 100/150 |
| 2,674,396 | 4/1954 | Peterson | 100/45 X |
| 4,117,776 | 10/1978 | Hunt | 100/147 X |
| 4,279,197 | 7/1981 | Hunt et al. | 100/117 |

FOREIGN PATENT DOCUMENTS

| | | | |
|---|---|---|---|
| 1219444 | 6/1966 | Fed. Rep. of Germany | 100/117 |
| 588476 | 5/1947 | United Kingdom | 100/145 |

*Primary Examiner*—Peter Feldman

*Attorney, Agent, or Firm*—Duckworth, Allen, Dyer & Pettis

[57] ABSTRACT

A predrainer type screw press for dewatering highly liquid materials having a feed and pressing screw in which the body of a portion of the feed section of the press is cylindrical and the body of a portion in the pressing section of the press is frusto conical having its small diameter end contiguous with the cylindrical body and of a smaller diameter. The feed portion of the screw is partially surrounded by a bar screen for permitting draining of free run liquids from a material to be dewatered. A pressure assisted overflow in the input hopper is provided to limit the material head in the hopper to prevent slippage and ensure positive feed. Baffles are provided to absorb energy from input material having a high velocity to prevent sticking of material to the screw. Pressing section filter screens are hinged to open out for easy access for cleaning and have a liquid tight seal at the ends when closed.

17 Claims, 7 Drawing Figures

SCREW PRESS IMPROVEMENTS

BACKGROUND OF THE INVENTION

1. Field of the Invention

The present invention relates to improvements to screw presses and more particularly to positive feed devices and removable screens for screw presses.

2. Description of the Prior Art

The screw press for separating liquids from solid matter has been widely used in a number of industries. The trend in the prior art appears to have been the development of specialized presses dedicated to particular materials. For example, our U.S. Pat. Nos. 4,279,197 and 4,266,473 are well suited to dejuicing grapes for the wine and juice industry. The '473 patent discloses a predrainer press for removing free run juice from grape must and utilizes the principle of a gradually tapered screw body which provides gentle pressing as the must moves from large volume flights to small volume flights. The '197 patent describes a final press utilizing a straight body screw and a large pressing chamber. The screw creates a pressure on the must in the chamber to thereby press out all of the usable juice, leaving a very dry residual cake. The present invention is concerned with the predrainer type of screw press and certain improvements that permit this type of press to be utilized in dewatering of a large variety of materials of varying consistencies and viscosities as well as fruits.

The following are typical problems encountered in using a predrainer type screw press with various types of materials:

1. Highly liquid material having low solid content.

When such material is introduced into the hopper, it is common for insufficient solids to accumulate in the screw flights to produce the desired pressure. The result is that excessively wet solids emerge from the press. In the past, it has been necessary to thicken such material by use of prestrainers, and other devices before pressing, adding to equipment and handling costs.

2. Heavy, spongy or viscous materials.

When these types of materials are fed into the inlet feed section of a predrainer press, there is a tendency for the solids to pack or stick to the screw body and thread faces. When this occurs, the mass of material turns with the screw and does not feed down the press. This action is termed "slippage." Incoming material then simply rests on the packed flights which slip past as the screw rotates.

3. Viscous material with too high a head in the inlet hopper.

Viscous material that would otherwise feed properly may slip when the height of the material in the hopper becomes excessive. The weight of the material then causes excessive packing and sticking of the material in the inlet flights of the feed screw producing slippage as discussed above.

4. Material fed under pressure.

Some types of material which are fed into a screw press under pressure may have a velocity sufficient to cause solids to stick to the feed screw which thereby results in slippage.

Therefore, a much needed improvement in predrainer type screw presses is a feed section and feed screw design that will permit a number of different highly liquid materials having a wide range of physical characteristics to be continuously fed to the press with positive feed of the material.

Another area needing improvement is that of the filter screens. Many materials tend to clog the filter screens which therefore require frequent cleaning of the screens. Our '197 patent discloses an important advance in this area. The screens are mounted on hinged frames which permit access to the inside surfaces by opening of the frames with a minimum disassembly of the machine. The disclosed design allows ease of cleaning but suffers from the problems of leakage around the edges of the frames. Thus, an improved edge seal is needed.

SUMMARY OF THE INVENTION

The present invention provides a predrainer type screw press having significant improvements over the known prior art. A screw press is provided with a tapered feed screw body having a small diameter at the input end and a large diameter at the output end so that the volume in the screw flights becomes less as material moves from the input end toward the output end. The feed screw is mounted and turned in a cylindrical cage formed by cylindrical filter screens attached to supporting frames. As is well known in the art, the feed screw carries material from the input end toward the output end such that pressure is exerted on the material against the screens, expressing liquid from the sides which passes through the screens for collection. Immediately ahead of the small diameter end of the feed screw body is an input feed section having a contiguous feed screw section with a uniform diameter body in which such diameter is somewhat greater than the smaller diameter of the tapered body section.

An inlet throat or hopper section is provided directly over the straight feed screw section. A filter screen is supported around the straight feed screw portion and is preferably replaceable to permit the screw press to be adapted to different types of materials. As will be descirbed in more detail hereinafter, we prefer to use a horizontal bar type screen at this point.

When it is desired to dewater highly liquid material having low solid content, such material may be fed directly into the input hopper sufficient to maintain a head somewhat above the top surface of the feed screw. Due to the presence of the screen, a majority of the free run liquid will quickly drain through the input screen with the input section thus acting as a thickener. This permits the solids to begin to build up in the screw flights as the material is being fed. Thus, the thickened solids will be moved forward by the rotation of the feed screw along the straight body portion thereof and dropped onto the tapered body portion. The partially drained solids will therefore be picked up by the tapered portion of the drive screw and carried forward. It is important to note that even if the feed section flights were filled with thickened solids, the smaller diameter of the pressing section at the point at which the solids enter that section will prevent the screw flights from being full. Therefore, there is no danger of slippage and the material will be moved forward.

As the material moves forward, drainage will be taking place of remaining free liquid and the partially drained solids will begin to fill the flights due to their steadily decreasing volume. At the point at which the solid material essentially fills the flight, known as the "pinch-point," it may be understood that further progression will result in a gentle squeezing of the solids to thereby express additional liquids therefrom. We have found experimentally that controlling the small diameter end of the pressing section relative to the straight diameter of the feed section will vary the point along the pressure screw at which the pinch-point occurs. We have determined that about half way along produces an optimum operation. The output end of the filter chamber is open, permitting the dewatered solids to issue therefrom and be collected.

As may be now recognized, the input drainage screens and the novel stepped construction of the feed screw body will permit a constant feed through the press of highly liquid material with low solid content.

As previously discussed, when heavy, spongy or viscous material is fed into the screw press, it is possible for the material to become packed into the flights of the feed section. As the screw portion rotates, it simply carries the material around without feeding forward. By the use of a drainage screen around the outer periphery of the feed screw threads, drag on the material will occur and prevent such slippage. As mentioned above, we prefer to use longitudinal bar screens finding that the bars produce maximum friction. However, for some materials, we have found that, while helpful, the bar screens do not completely eliminate slippage since they affect only the outer part of the material packed into the flights. We have determined that packing can occur due to an excessive volume of material in the hopper producing a high head pressure which contributes to the aforementioned packing. Viscous and fibrous materials appear to be particularly prone to this problem.

To overcome this problem, we have provided an overflow port in the feed hopper having a discharge pipe coupled thereto. The bottom of the overflow pipe is therefore placed at the approximate maximum material head desired which will produce positive feed without causing packing of the material. If the hopper tends to fill beyond this level, as is apparent, the material will flow into the overflow pipe thereby relieving the head pressure. The overflow pipe may be connected back to return the overflow material to the original source. When the material is highly liquid, the overflow pipe may be angled downward to thereby utilize gravity for flow. However, for materials with more solids or for viscous materials, we provide a pressure line disposed in the overflow pipe to assist the overflow action. For example, where the liquid is water, the pressure source could be water under pressure. A simple float arrangement may be provided to turn on the pressure when the head level in the hopper exceeds the desired level.

In other applications of the screw press of the invention, it may be desirable to feed materials having rather high solid content under pressure into the hopper through pipes or from a gravity feed having a high drop distance. Under these circumstances we have found that some types of material will strike the feed portion of the feed screw with sufficient velocity to cause the solids to stick and to build up in the flights. Thus, as the flights become full, slippage occurs with the result that no further feeding takes place. To prevent this action, we provide a hopper or feed inlet section having a multiplicity of small baffles across the inlet. This causes the solids to be broken up into very small portions and to give up their high velocity. Thus, the smaller particles fall from the baffles at a low velocity which is insufficient to cause the undesired sticking. Thus, the material is moved along by the feed screw into the press portion without slippage.

In the press portion of the screw press of the invention, screens are provided having two semi-cylindrical frames with off-set hinges at the bottom such that the cylinder formed by the two screen frames may be opened in book-like fashion. Due to the off-set at the bottom, the screen frames, when opened, move outward and downward with respect to the feed screw to permit clear access to the screens for cleaning or replacing. To prevent leakage at the rear and forward edges of the screen frames during operation of the press, we have provided a tapered ring at each end with the outside rib of each screen frame having a complementary taper such that when the screen frames are closed, the tapered surfaces mate tightly. Bolts are used to secure the frames in the closed position, and which are easily removable for opening of the frames for cleaning or changing of the screens.

It is therefore a principal object of the invention to provide an improved predrainer type screw press that can handle materials having high liquid content and solids having a wide variety of physical characteristics with a continuous movement of material through the press.

It is another object of the invention to provide a predrainer type screw press having straight feed screw portion of the screw at the input end followed by a tapered portion having a gradually increasing body diameter.

It is still another object of the invention to provide an improved screw press having a replaceable filter screen around the straight screw feed section for thickening of highly liquid materials.

It is yet another object of the invention to provide a bar type screen around the input feed section of the feed screw to provide friction for wet solids in the feed section flights to prevent slippage thereof.

It is a further object of the invention to provide a screw press for materials with a high liquid content having means for controlling the head of material in the inlet hopper portion so as to prevent packing of solids in the inlet feed screw for prevention of slippage.

It is yet a further object of the invention to provide an overflow system in the inlet hopper section of a screw press for maintaining a desired head therein.

It is another object of the invention to provide an inlet hopper for a predrainer type screw press having a multiplicity of baffles therein to absorb the energy of incoming material so as to permit the material to fall into the feed screw at a low velocity for prevention of sticking and slippage.

It is still another object of the invention to provide improved feed screw filter screen frames which are easily accessible, which may be quickly opened for cleaning or replacing, and which provides positive seals at their forward and rearward ends.

These and other objects and advantages of our invention will become apparent from the following detailed description when read in conjunction with the drawings.

DETAILED DESCRIPTION OF THE PREFERRED EMBODIMENT

The present invention contemplates a predrainer screw press having certain improvements over the prior art that permit the press to be used for dewatering or dejuicing of a wide range of materials varying from a few percent solids to a high percentage of solids. It is further contemplated that the screw press of the invention can be built as a specialized machine for one type of material or may be constructed with interchangeable elements such that the screw press may be easily and quickly adapted to a particular desired material or to variations in the percentages of liquids and solids in one type of material.

Figure 1:
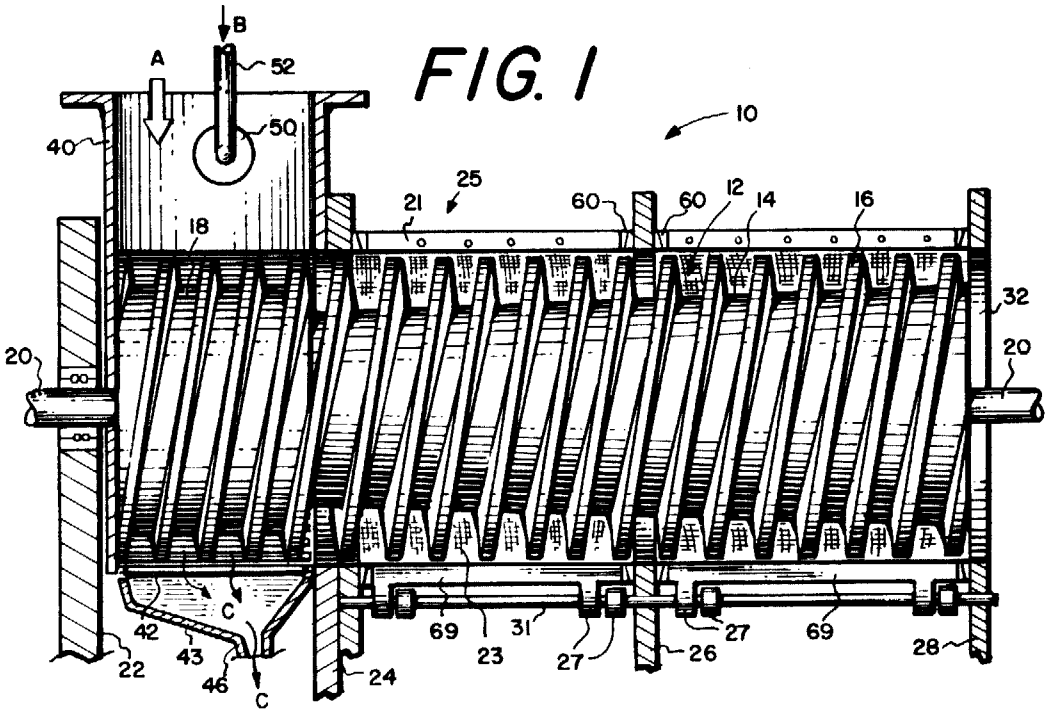
FIG. 1 is a cross-sectional view of a predrainer screw press of the invention showing an overflow apparatus in the inlet hopper section for maintaining a desired head of material in the hopper.
Figure 2:
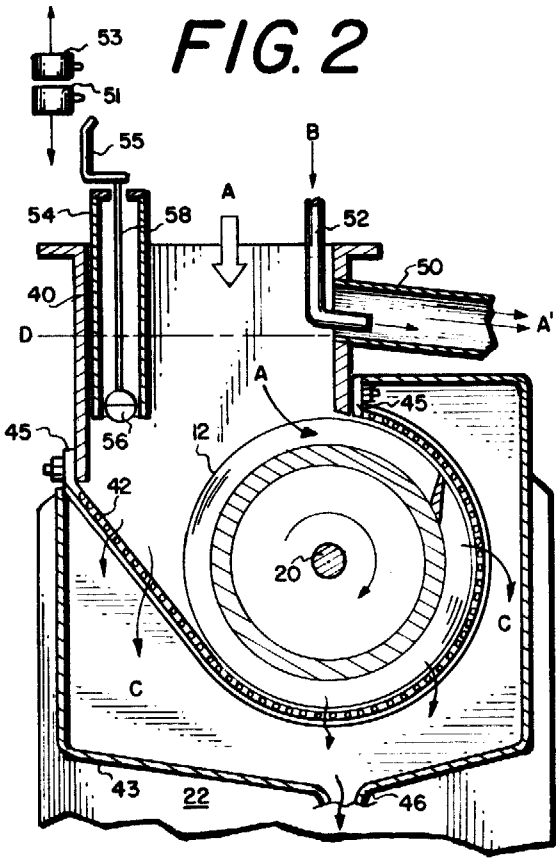
FIG. 2 is a cross-section of the screw press of FIG. 1 and at right angles thereto through the feed section showing additional features of the overflow apparatus.

Referring to FIG. 1 and FIG. 2, cross-sectional views of a preferred embodiment of our improved screw press is shown which is especially adapted to extraction of solids from a highly liquid material. In FIG. 1, a feed screw 12 is shown concentric with driving shaft 20 and having two body portions 18 and 14. A continuous screw thread 16 is provided over both body sections 18 and 14. Body section 18 of the inlet feed portion of feed screw 12 may be noted to have a uniform cylindrical shape. The purpose of this portion of feed screw 12 is to permit control of the incoming material so as to build up sufficient solids in the flights of the screw to cause the wet solids to be urged forward, defined as moving from left to right in FIG. 1, without packing and slipping. Body portion 14, which may be seen to extend from right end of straight body portion 18 to the forward end of the press, has a small diameter at the inlet end and a large diameter at the outlet end. Assuming that the screw flights associated with body 18 were filled with wet solids and that the solids were being fed forward, it may be seen that the volume of the flights at the beginning of body portion 14 is greater than that of the feed section flights. Therefore, the material will be easily fed forward without slippage. However, a point will be reached as the material progresses at which time the volume in the flight is the same as in that of the inlet section and as a result, further movement will tend to decrease that volume expressing liquid from the wet solids. The force of the material being fed will assist in maintaining the forward feed as the material is subjected to more and more pressure and finally exits the press through opening 32 in end bulkhead 28.

While the size of the feed screw 12 and the pitch of threads 16 may be varied with the throughput volume desired for a screw press, we have found that an efficient predrainer type screw press can be built suitable for a wide variety of materials using an outside diameter of screw threads 16 of 24 inches, the diameter of the straight body section 18 of 20 inches, a maximum diameter of the tapered body 14 of 24 inches, and a diameter of the smaller end of tapered body 14 of 18 inches in diameter. The length of the straight section 18 may be on the order of 12 inches with a 4 inch pitch for threads 16. The length of the tapered body portion of the feed screw 12 may be 4 feet.

As may be understood, feed screw 12 is driven through shaft 20 by any desired driving means, not shown. Also means, as is well known, will be provided for collection of liquid expressed through filter screens 25 and for the dewatered solids which are extruded from opening 32.

Referring to FIG. 2, a cross-sectional view of the feed section of the screw press of FIG. 1 is shown at right angles to the feed screw 12. An inlet hopper 40 is provided which is attached to transverse members 22 and 24 through which material is fed to feed screw 12. A special screen 42 is disposed around feed screw 12 and attached to hopper 40 by lugs 45. Preferably, screen 42 is of the horizontal bar type with the bars running parallel with the axis of feed screw 12. When highly liquid materials are input to the screw press as indicated by arrow A, the free run or liquid which is not tied up with the solids will freely flow through screen 42 as indicated by arrows C permitting the wet remaining solids to begin to collect in the hopper area. The drained liquid collects in pan 43 which is drained via outlet 46. For liquids which have very little solids, we have found it desirable to replace bar screens 42 with mesh screens having 0.100 to 0.050 openings. As may now be understood, the use of screen 42 to drain free running liquids at this point obviates the requirement for thickening of the material before entering the press.

As the solids begin to build up in the inlet hopper area, the rotation of feed screw 12 as indicated by the curved arrow will tend to move the material forward. When large volumes of material are injected as indicated by arrow A, the solids will tend to continue to increase in inlet hopper 40. We have found that an excessive head of wet material will cause such material to pack into the flights in this feed portion with the result that the material turns with the screw threads and slips by the material in the hopper. Therefore, there is no movement of the material forward as is desired requiring halting of the operation and removal of excess material. Advantageously, our invention prevents such slippage through the combination of screen 42 and a novel overflow shown in FIGS. 1 and 2. Assuming that dashed line D represents a maximum height for a material above which packing and slippage can occur, an overflow pipe 50 is provided to permit material that would tend to collect above level D to flow out as shown by arrows A'. For liquids with certain types or amounts of solids, we have found it preferable to assist the overflow by use of pressure assist pipe 52. For example, when the liquid being extracted is water, such as is common in pulp mills, sewage treatment, and the like, pipe 52 may be connected to a source of water pressure controlled by solenoid valves. Since it is not desirable that flow from pipe 52 be continuous, we may provide a simple float valve arrangement 54 in which float 56 raises float rod 58 as the material head rises in inlet hopper 40. Two electrical switches 51 and 53 may be operated by actuator 55 as the level rises. When switch 51 is closed, it may operate a solenoid valve to turn the water pressure on to pipe 52 to assist in the overflow. If the incoming material at A is at too high a rate that the overflow 50 cannot maintain the level D, float 56 would continue to rise then operating switch 53 which would be connected to momentarily cutoff the flow of material at A to permit level D to be achieved. Thus, our overflow control would be effective to maintain a level D which is selected to keep the weight of the material sufficiently low to prevent packing of the flights of feed screw 12. Although not shown, it would be obvious to those of skill in the art that hopper 40 may be extended upward and means provided to adjust the height of overflow pipe 50 and float system 54 for applications in which different types of material may be used to permit adjustment of level D.

Figure 3:
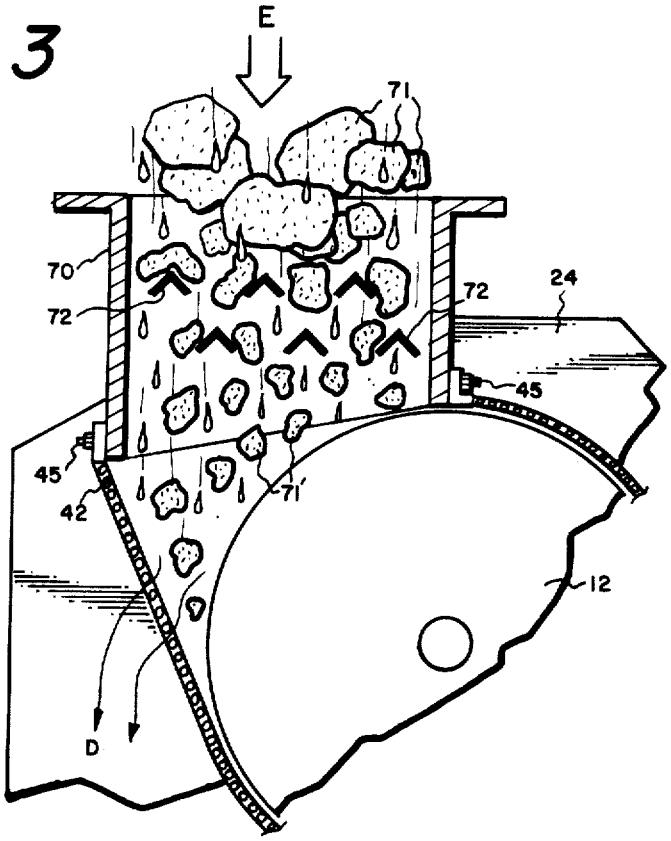
FIG. 3 is a transverse cross-section of an inlet hopper arrangement for a predrainer type screw press shown in cross-section having baffles for absorbing energy from incoming materials.

Turning now to FIG. 3, an alternative inlet hopper is shown, which we have found to be advantageous for material having high solid content which may be somewhat sticky and which is normally fed into hopper 70 (as indicated by arrow E) with relatively high velocity. For example, material 71 may be pumped through feed pipes or may be falling by gravity from conveyors such that the material acquires a relatively high velocity before entering hopper 70. We have found that the solids striking the flights of feed screw 12 will cause sticking such that the build up of the solids as the free run liquid drains off (as indicated by arrows B) will result in the solids turning with feed screw 12. As previously discussed, the material is not fed forward in such circumstances and will merely slip by the material which will accumulate in the hopper. To overcome this problem we provide a multiplicity of baffles 72. Shown only for exemplary purposes, baffles 72 in FIG. 3 may be lengths of angle iron or, alternatively, flat strips, rods, or other obvious structures. As the solids 71 strike the baffles, the solids will be broken up into smaller pieces having a much lower velocity than the incoming material. In effect, the material may simply drop from the baffles as at 71' into the flights of feed screw 12 without sufficient velocity to stick. Therefore, as the flights fill up the material is moved forward as desired. As will be obvious to those of skill in the art, baffles 72 may be selected as appropriate for the type of material 71 to be handled and the numbers and sizes also adjusted accordingly.

Figure 4:
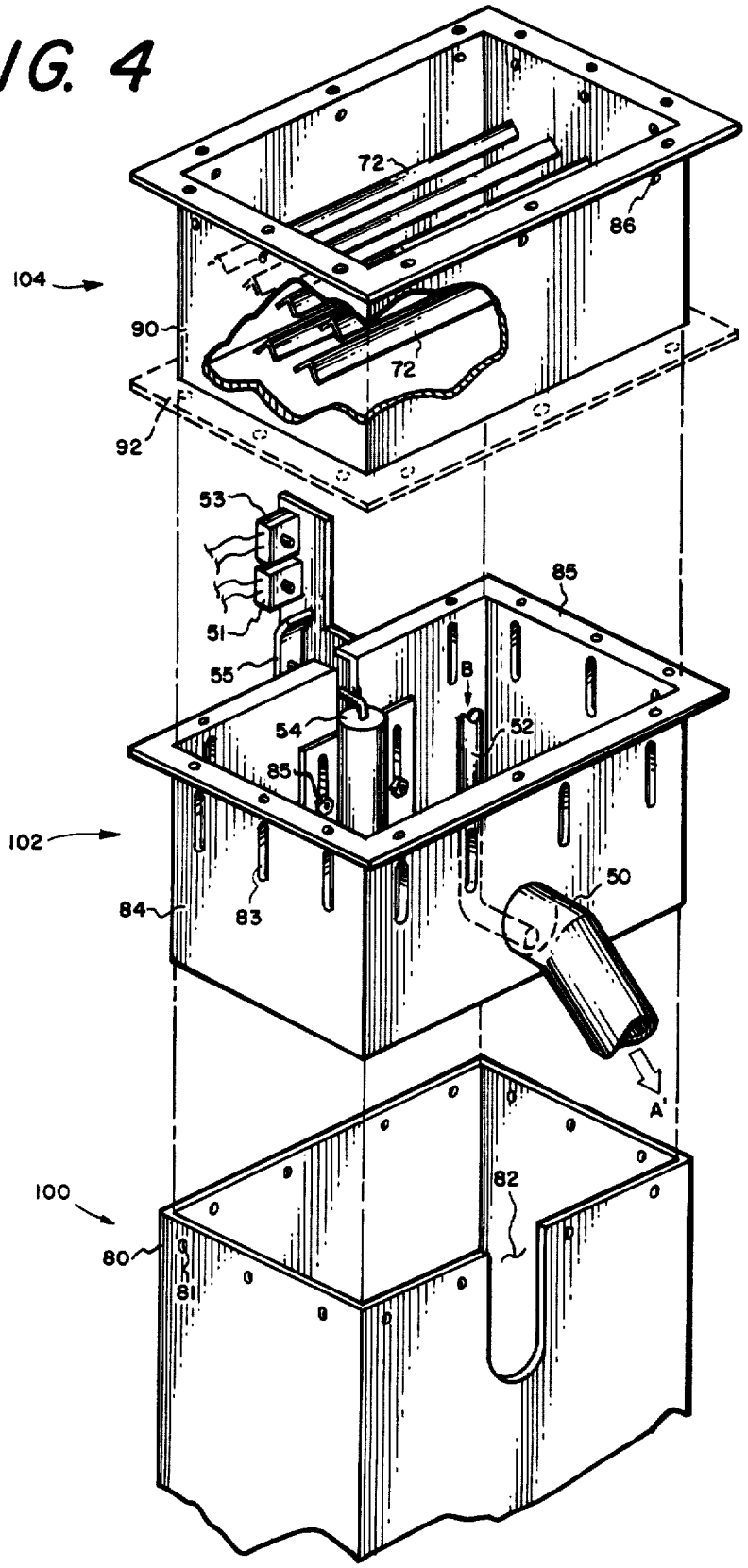
FIG. 4 illustrates an inlet hopper arrangement for the screw press of the invention in which either a head control apparatus or an inlet baffle apparatus may be selectively attached thereto.

Our invention contemplates a predrainer type screw press machine which can be adapted for a wide range of materials. FIG. 4 shows a partial view of an inlet chamber or hopper for a universal type machine. Two separate feed controls 102 and 104 may be provided which are to be attached to inlet hopper 100 in accordance with the type of material to be handled. For example, when highly liquid types of material is to be dewatered, and the overflow system of FIG. 1 and 2 is to be used, feed control unit 102 is inserted into body 80 of inlet hopper 100 and fastened in place by bolts through holes 81 and slots 83. Overflow pipe 50 fits into slot 82. The head level which is controlled by the position of overflow pipe 50 may be varied over a limited range by sliding unit 102 up and down in slots 83. Float unit 54 which operates switches 51 and 53 may be provided with slots 85 to permit adjustment of the level at which switches 51 and 53 are operated.

Where the material to be dewatered has a high solid content and is of a heavy sticky consistency, hopper unit 104 may be inserted into inlet hopper 100. In such case, feed control 104 which includes a multiplicity of baffles 72 may have its body portion 90 inserted into hopper body unit 80 and bolted through holes 81 and 86. In some applications it may be desired to use both overflow feed control unit 102 and baffle feed control unit 104 at the same time. In this case, a version of baffle unit 104 having a lower flange 92 indicated by dashed lines may be bolted to flange 85 of overflow unit 102 which is inserted into hopper body unit 80. In such case, both the velocity of the impinging solids and the height of the head which is reached in the hopper may be controlled.

Figure 7:
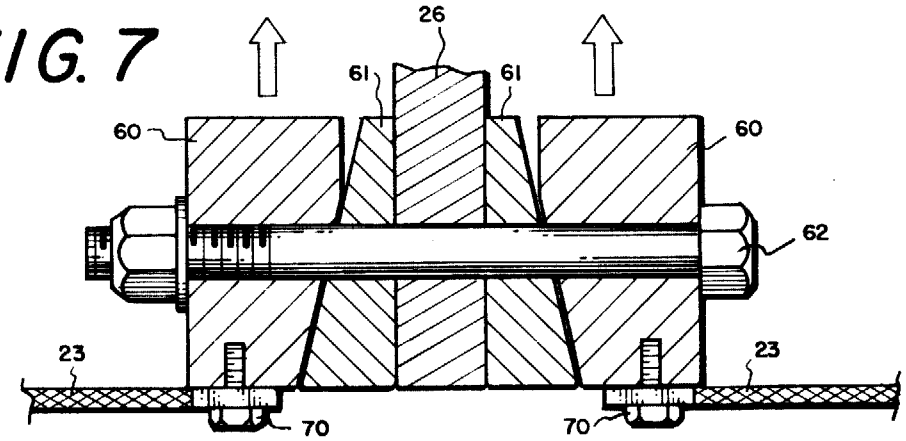
FIG. 7 shows a partial cross-sectional view of adjacent screen frames of FIGS. 5 and 6 in the closed position.
Figure 5:
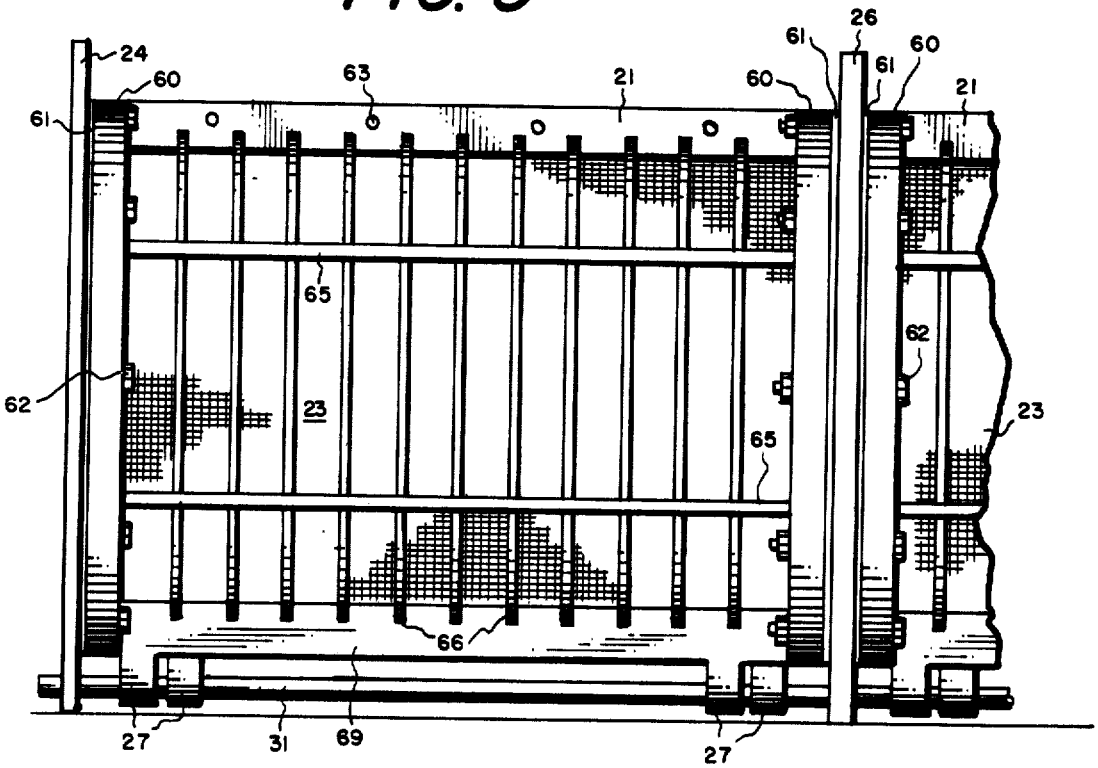
FIG. 5 shows a side view of one section of the screw press of the invention showing an improved screen frame arrangement.
Figure 6:
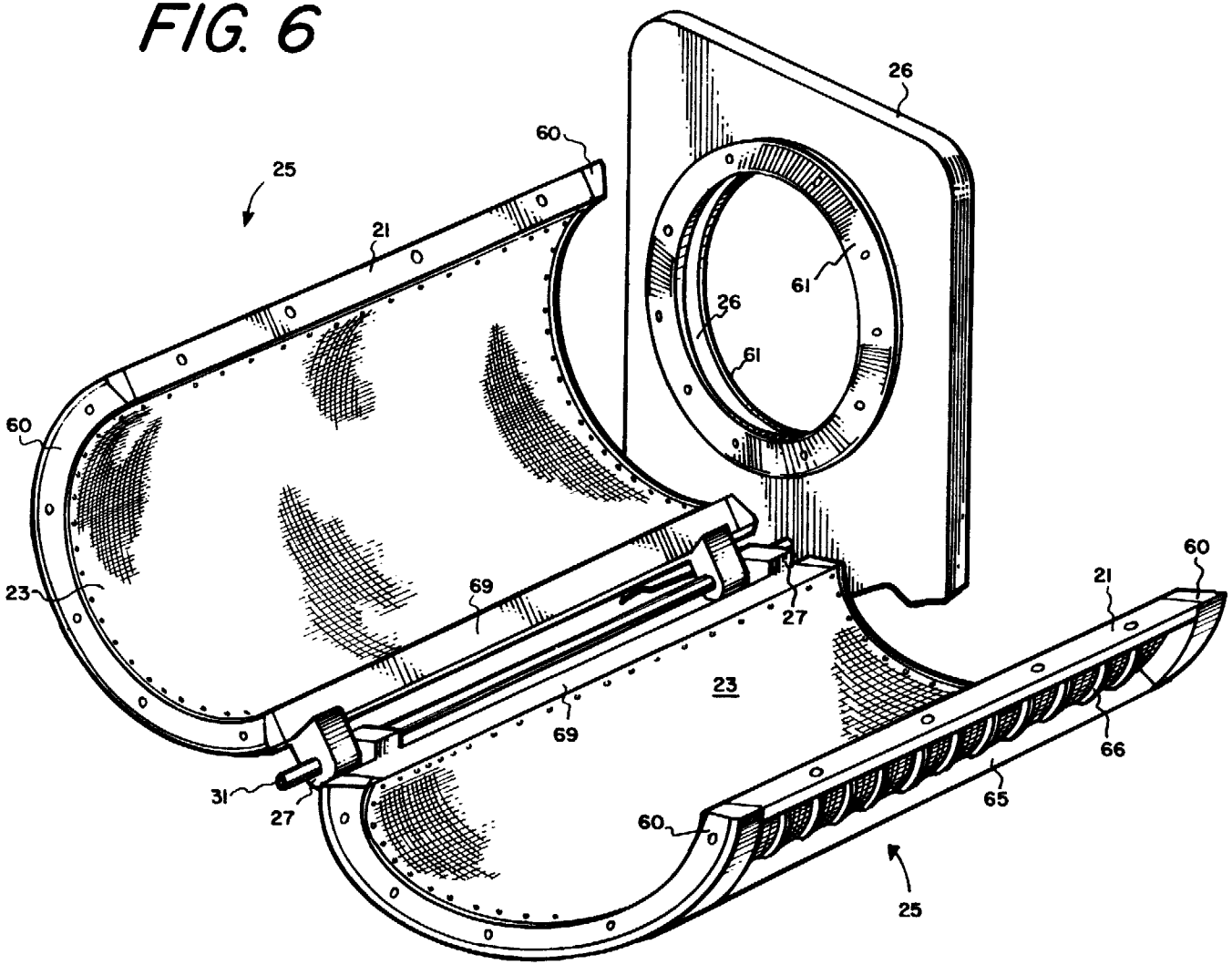
FIG. 6 shows a perspective view of the screen frames of FIG. 5 in an open position with other parts of the screw press omitted for clarity.

An improved screen frame for our screw press will be explained with reference to FIGS. 5, 6 and 7. A side view of one cage section of the screw press of FIG. 1 is shown. As best seen in FIG. 6, each filter section consists of two semicylindrical screen frames 25 having a large rib 60 at each end and a plurality of smaller ribs 66 disposed along the outer surface thereof. Longitudinal struts 65 serve to provide support to ribs 66. A hinge element 69 having hinge bosses 27 at each end is attached at the bottom ends of ribs 60 and 66 and a fastening bar 21 is attached to the upper ends of ribs 60 and 66. As may be noted, hinge bosses 27 of the two halves are interleaved and pivot on shaft 31 through transverse bulkhead members 24, 26 and 28. As may be noted from FIG. 6, the desired screening material is formed in a half cylinder to fit inside of frames 25 and may be attached around the perimeter by suitable screws or other type fasteners. It is desirable that these fasteners be easily removable to permit changing of screens to suit particular types of liquids to be extracted. When the screen frames 25 are in the operating position, they are closed with fastening strips 29 bolted together by bolts 63 and the outer ribs are bolted to the bulkhead members 24, 26 and 28 by bolts 62 which pass through tapered rings 61. Details of this attachment are shown in FIG. 7. As may be noted, outer ribs 60 of screen frames 25 are tapered. Tapered rings 61 are welded or otherwise attached to bulkhead member 26 such that with the screen frames 25 closed, the tapered surfaces of ribs 60 and ring 61 mate to provide a liquid tight joint which is readily separated when it is desired to open the screen frames 25. Bolts 62 serve to securely fasten ribs 60 to bulkhead 26 when the press is in operation. When bolts 62 are removed, the screen frames 25 will very easily swing open and away from the tapered ring 61 as indicated by arrows E in FIG. 7.

As may now be recognized, we have disclosed improvements for a screw press suitable for highly liquid materials, viscous materials and material fed under pressure that ensure positive feed with minimum slippage. Improved drain screens are disclosed which open out for ease of cleaning and replacement, and which have a positive liquid seal at their ends when closed. Although particular examples have been given, we do not intend to limit the invention to the disclosed structures since it will be obvious to make various changes and substitutions without departing from the spirit and scope of the invention.

We claim:

1. In a predrainer type screw press for dewatering highly liquid material having low solid content; heavy, spongy or viscous materials; and material fed under pressure, the improvements comprising:

an input feed section of said screw press;

a cylindrical material pressing section having an outlet end;

a rotatable feed and compression screw having a first cylindrical body concentrically disposed in said feed section and a second frusto conical shaped body concentrically disposed in said material pressing section, said second body contiguous with said first body, the diameter of said first body greater than the diameter of said second body at the point of contiguity, said second body tapering outward from said point of contiguity, and a screw thread continuously disposed helically around the surface of said first and second bodies, the slope of said second body selected to provide a gradual reduction in volume of the flights of said screw thread from said point of contiguity to said outlet end, the diameter of said second body at said point of contiguity selected to produce a pinch point at a desired location along said feed screw in said material pressing section;

an inlet throat section disposed directly into said input feed section over said first body portion of said feed and compression screw; and an input filter screen disposed around said screw thread partially over the length of said first cylindrical body, said screen having openings therein to permit free run liquid to drain therethrough.

2. The improvements as defined in claim 1 in which said input filter screen is of the horizontal bar type wherein the bars thereof are parallel with the axis of said feed screw.

3. The improvements of claim 1 in which said material pressing section includes a cylindrical cage formed by at least one pair of semi-cylindrical frames, said frames supporting output filter screens to pass liquid extracted from said materials.

4. The improvements as defined in claim 1 in which said throat section includes slippage prevention means operative in combination with said input filter screen to prevent slippage of wet material in said input feed section.

5. The improvements as defined in claim 4 in which said slippage prevention means comprises means for maintaining a head of material in said throat section at a preselected level.

6. The improvements as defined in claim 5 in which said means for maintaining said head at said preselected level comprises overflow means.

7. The improvements as defined in claim 6 in which said overflow means includes an overflow pipe disposed to produce an overflow of the material when the level of said head exceeds said preselected level.

8. The improvements as defined in claim 7 which further comprises pressure assist means for producing a flow of liquid under pressure in said overflow pipe to increase the flow of material in said overflow pipe.

9. The improvements as defined in claim 8 in which said pressure assist means includes control means for controlling said flow to occur when the level of said head exceeds said preselected level.

10. The improvements as defined in claim 9 in which:

said overflow pipe is adjustable to thereby adjust said preselected level; and said control means is adjustable to thereby adjust the point of operation of said pressure assist means.

11. The improvements as defined in claim 10 in which said control means includes:

a float having switch actuation means, said float level responsive to said head level;

a solenoid valve for controlling said flow of liquid; and electrical switch connected to control said solenoid valve and disposed to be closed by said float when the level of said head exceeds said preselected level.

12. The improvements as defined in claim 11 which further includes a second electrical switch for connection to material flow controls and operable by said float to stop the flow when the flow of material is excessive.

13. The improvements as defined in claim 4 in which said throat section further comprises means for preventing input solids having a relatively high velocity from sticking to said feed screw.

14. The improvements as defined in claim 13 in which said sticking preventing means includes a plurality of baffles disposed in said throat section for absorbing energy and breaking up said solids prior to their contact with said feed screw.

15. The improvements as defined in claim 5 in which said slippage preventing means is adjustable to select said preselected level.

16. A predrainer type screw press having positive feed for materials having high liquid content comprising:

a cylindrical cage formed by at least one pair of semicylindrical frames, said frames supporting filter screens for passing liquid extracted from said materials, said pair of frames attached to offset hinges disposed along the lower edges thereto to permit opening said cage for cleaning or replacement of said screens, said frames having forward facing and rearward facing end ribs, each of said end ribs having an inwardly tapering face thereof;

at least two transverse bulkhead members supporting said offset hinges and having circular openings therethrough;

at least two circular rings having an outwardly tapering face, complementary to said inwardly tapering face of said end ribs when in the closed position of said frames, one of said rings disposed around each of said circular openings whereby said end ribs mate with said rings to form a liquid tight joint;

a rotatable compression screw having a frusto conical first body disposed concentrically within said cage with the small end of said body at the forward end thereof and the large end at the rearward end thereof and a screw thread continuously disposed helically around the surface of said first body, the outside diameter of said thread essentially equal to the inside diameter of said cage;

an input feed section of said screw press adjacent the forward end of said cage;

a rotatable feed screw disposed within said feed section having a cylindrical second body concentric with and contiguous to said small end of said first body, said screw thread also continuously disposed helically around the surface of said second body, the diameter of said second body being greater than the diameter of said small end of said first body;

a replaceable bar screen disposed partially around said feed screw over the length of said second body, said screen having openings therein to permit free-run liquid to drain therethrough; and an inlet hopper section communicating with said feed section for introduction of said materials.

17. A predrainer type screw press having positive feed for materials having high liquid content comprising:

an input feed section;

a cylindrical output pressing section adjacent to said input feed section;

a rotatable compression screw having a frusto conical first body disposed concentrically within said pressing section with the small end of said body at the forward end thereof and the large end at the rearward end thereof and a screw thread continuously disposed helically around the surface of said first body, the outside diameter of said thread essentially equal to the inside diameter of said cylindrical pressing section;

a rotatable feed screw disposed within said feed section having a cylindrical second body concentric with and contiguous to said small end of said first body, said screw thread also continuously disposed helically around the surface of said second body, the diameter of said second body being greater than the diameter of said small end of said first body;

a replaceable filter screen disposed partially around said feed screw over the length of said second body, said screen having openings therein to permit free-run liquid to drain therethrough; and an inlet hopper section communicating with said input feed section for introduction of said materials.

* * * * *